US009564086B2

(12) United States Patent
Ye et al.

(10) Patent No.: US 9,564,086 B2
(45) Date of Patent: Feb. 7, 2017

(54) METHOD AND SYSTEM FOR IMPROVING RGBW IMAGE SATURATION DEGREE

(71) Applicants: BOE TECHNOLOGY GROUP CO., LTD., Beijing (CN); Chengdu BOE Optoelectronics Technology Co., Ltd., Chengdu, Sichuan Province (CN)

(72) Inventors: Hongna Ye, Beijing (CN); Zihe Zhang, Beijing (CN)

(73) Assignees: BOE TECHNOLOGY GROUP CO., LTD., Beijing (CN); CHENGDU BOE OPTOELECTRONICS TECHNOLOGY CO., LTD., Chengdu, Sichuan Province (CN)

( * ) Notice: Subject to any disclaimer, the term of this patent is extended or adjusted under 35 U.S.C. 154(b) by 194 days.

(21) Appl. No.: 14/472,163

(22) Filed: Aug. 28, 2014

(65) Prior Publication Data

US 2015/0325203 A1 Nov. 12, 2015

(30) Foreign Application Priority Data

May 7, 2014 (CN) ..... 2014 1 0190637

(51) Int. Cl.

| | |
|---|---|
| ***G09G 5/02*** | (2006.01) |
| ***G09G 3/34*** | (2006.01) |
| ***G09G 3/20*** | (2006.01) |

(52) U.S. Cl.

CPC ..... *G09G 3/3426* (2013.01); *G09G 3/20* (2013.01); *G09G 5/02* (2013.01);

(Continued)

(58) Field of Classification Search

None

See application file for complete search history.

(56) References Cited

U.S. PATENT DOCUMENTS

| | | | | |
|---|---|---|---|---|
| 8,670,007 | B2 * | 3/2014 | Shiomi | G09G 3/3607 345/690 |
| 2003/0142879 | A1 * | 7/2003 | Kim | H04N 1/6005 382/274 |

(Continued)

FOREIGN PATENT DOCUMENTS

| | | | |
|---|---|---|---|
| CN | 101370148 | A | 2/2009 |
| CN | 101378514 | A | 3/2009 |

(Continued)

OTHER PUBLICATIONS

First Office Action for CN Application No. 201410190637.1, Dated Aug. 19, 2015, 5 pages.

*Primary Examiner* — Anh-Tuan V Nguyen

(74) *Attorney, Agent, or Firm* — Kinney & Lange, P.A.

(57) ABSTRACT

A method and a system for improving saturation degree of a RGBW image are provided. The method comprises: a step A of dividing a screen into a plurality of screen sub-regions according to a region range in which backlight is independently and dynamically adjustable; a step B of dividing the RGBW image to be displayed into sub-areas on the basis of the screen sub-regions, the sub-areas of the RGBW image to be displayed corresponding to the screen sub-regions; a step C of determining the sub-areas having saturation degree to be adjusted in each sub-area of the RGBW image to be displayed; and a step D of reducing backlight brightness of the sub-areas having saturation degree to be adjusted by a predetermined proportion when the RGBW image to be displayed is displayed. By means of the method and the system, saturation degree of the RGBW image may be adjusted finely.

17 Claims, 8 Drawing Sheets

(52) U.S. Cl.
CPC ..... *G09G 2300/0452* (2013.01); *G09G 2320/0242* (2013.01); *G09G 2320/0271* (2013.01); *G09G 2320/0646* (2013.01); *G09G 2330/021* (2013.01)

(56) References Cited

U.S. PATENT DOCUMENTS

2007/0222740 A1* 9/2007 Hanada ..... G09G 3/3406 345/102
2009/0207182 A1* 8/2009 Takada ..... G09G 3/3406 345/589
2010/0103089 A1* 4/2010 Yoshida ..... G09G 3/2022 345/102
2010/0103187 A1* 4/2010 Linssen ..... G09G 3/2003 345/590
2011/0115829 A1* 5/2011 Ito ..... G09G 3/3426 345/690
2011/0285764 A1* 11/2011 Kimura ..... G09G 3/3426 345/697
2012/0001947 A1 1/2012 Chu-Ke et al.
2012/0062584 A1* 3/2012 Furukawa ..... H04N 9/3111 345/589
2012/0075353 A1* 3/2012 Dong ..... H04N 5/58 345/690
2012/0206512 A1* 8/2012 Kim ..... G02F 1/133514 345/691
2013/0050426 A1* 2/2013 Sarmast ..... G01S 17/89 348/46
2013/0093783 A1* 4/2013 Sullivan ..... G09G 5/06 345/601
2013/0155119 A1* 6/2013 Dai ..... G09G 3/3406 345/690
2013/0176283 A1* 7/2013 Nakata ..... G06F 3/042 345/175
2014/0043357 A1* 2/2014 Yamato ..... G09G 3/3607 345/603
2014/0092147 A1* 4/2014 Kimura ..... G09G 3/3426 345/690
2014/0267456 A1* 9/2014 Ando ..... G09G 3/001 345/690
2014/0300618 A1* 10/2014 Wyatt ..... G06T 5/009 345/589
2015/0009361 A1* 1/2015 Liu ..... H04N 5/2356 348/229.1
2015/0097853 A1* 4/2015 Bastani ..... G09G 5/10 345/589

FOREIGN PATENT DOCUMENTS

CN 101378514 A 4/2009
CN 101587702 A 11/2009
CN 102122501 A 7/2011

* cited by examiner

METHOD AND SYSTEM FOR IMPROVING RGBW IMAGE SATURATION DEGREE

CROSS-REFERENCE TO RELATED APPLICATION

This application claims the benefit of Chinese Patent Application No. 201410190637.1 filed on May 7, 2014 in the State Intellectual Property Office of China, the disclosure of which is incorporated in entirety herein by reference.

BACKGROUND OF THE INVENTION

Field of the Invention

The present disclosure relates to a technical field of image display, more particularly, relates to a method and a system for improving RGBW image saturation degree.

Description of the Related Art

In the image display field, since the RGB three color system has a low light mixing efficiency and thus outputs a white light with poor color rendering index, it is replaced by the four color RGBW system gradually. The RGBW four color system not only includes red pixels (R), green pixels (G) and blue pixels (B), but also includes brightness enhanced pixels (W) so as to completely achieve all of functions which may be achieved by the RGB three color system. The four color RGBW system has advantages of high optical efficiency and high color rendering index.

However, as W sub-pixels are added into the RGBW four color system, the saturation degree of pure colors in the image may be degraded. Specifically, the absolute digital values of pure colors in a RGBW display are same to those in a RGB display. However, when the RGBW display includes the background, as the brightness of the background caused by the W sub-pixels is greater than the brightness of the RGB display, the pure colors in the background of the RGBW display look relatively dark, i.e., the brightness of the pure colors is degraded relatively. In comparison with the RGB display, the saturation degree of the pure colors of the RGBW display is degraded relatively due to poor relative brightness.

SUMMARY OF THE INVENTION

The present disclosure provides a method and a system for improving saturation degree of RGBW image to achieve a classification of the RGBW image in one frame on the basis of regions and to improve the saturation degree of the RGBW image according to the classification results.

According to an aspect of the present disclosure, there is provided a method for improving saturation degree of a RGBW image, comprising:

a step A of dividing a screen into a plurality of screen sub-regions according to a region range in which backlight is independently and dynamically adjustable on the screen;

a step B of dividing the RGBW image to be displayed into sub-areas on the basis of the screen sub-regions, the sub-areas of the RGBW image to be displayed corresponding to the screen sub-regions;

a step C of determining the sub-areas having saturation degree to be adjusted in all sub-area of the RGBW image to be displayed; and a step D of reducing backlight brightness of the sub-areas having saturation degree to be adjusted by a predetermined proportion when the RGBW image to be displayed is displayed.

According to another aspect of the present disclosure, there is provided a system for improving saturation degree of a RGBW image, comprising:

an image division and classification module configured to divide the RGBW image to be displayed into sub-areas according to a region range in which backlight is independently and dynamically adjustable on the screen and to determine sub-areas having saturation degree to be adjusted; and a sub-area dynamic backlight control module configured to reduce the backlight brightness of the sub-areas having saturation degree to be adjusted.

BRIEF DESCRIPTION OF THE DRAWINGS

The above and other features of the present invention will become more apparent by describing in detail exemplary embodiments thereof with reference to the accompanying drawings, in which.

DETAILED DESCRIPTION OF PREFERRED EMBODIMENTS OF THE INVENTION

Figure 1:
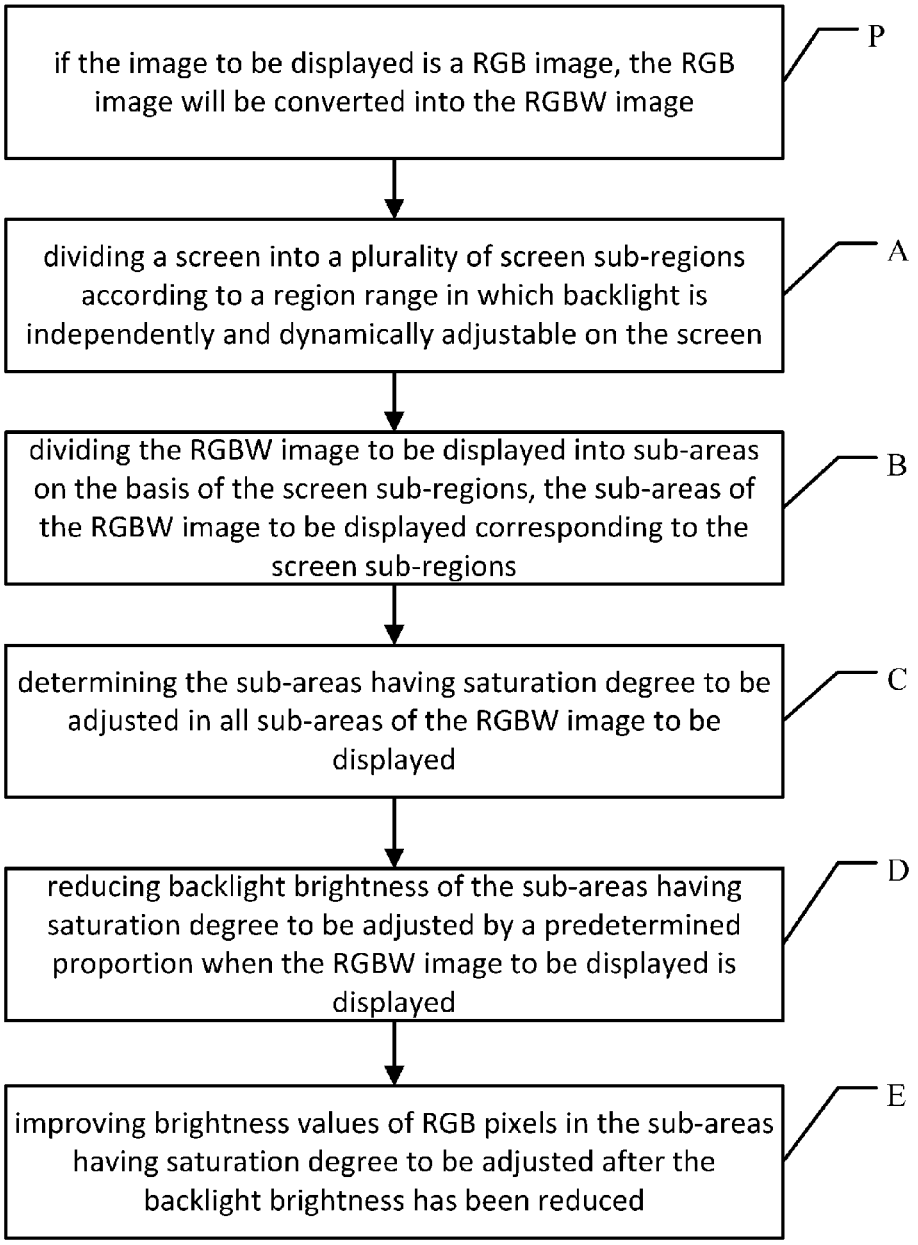
FIG. 1 is a flow chart of a method for improving saturation degree of the RGBW image according to an embodiment of the present invention.

Exemplary embodiments of the present disclosure will be described hereinafter in detail with reference to the attached drawings, wherein the like reference numerals refer to the like elements. The present disclosure may, however, be embodied in many different forms and should not be construed as being limited to the embodiment set forth herein; rather, these embodiments are provided so that the present disclosure will be thorough and complete, and will fully convey the concept of the disclosure to those skilled in the art.

Further, although the present disclosure provides embodiments/examples with specific values of parameters, these parameters are not intended to use these values exactly, but approximate the corresponding values within acceptable tolerance or design constraint. The terms regarding orientations, for example, "up", "down", "front", "behind", "left", "right" and the like in the embodiments are only directed to the orientations shown in figures.

According to a general concept of the present invention, there is provided a method for improving saturation degree of a RGBW image, comprising: a step A of dividing a screen into a plurality of screen sub-regions according to a region range in which backlight is independently and dynamically adjustable on the screen; a step B of dividing the RGBW image to be displayed into sub-areas on the basis of the screen sub-regions, the sub-areas of the RGBW image to be displayed corresponding to the screen sub-regions; a step C of determining the sub-areas having saturation degree to be adjusted in all sub-areas of the RGBW image to be displayed; and a step D of reducing backlight brightness of the sub-areas having saturation degree to be adjusted by a predetermined proportion when the RGBW image to be displayed is displayed.

According to a general concept of the present invention, there is provided a system for improving saturation degree of a RGBW image, comprising: an image division and classification module configured to divide the RGBW image to be displayed into sub-areas according to a region range in which backlight is independently and dynamically adjustable on the screen and to determine sub-areas having saturation degree to be adjusted; and a sub-area dynamic backlight control module configured to reduce the backlight brightness of the sub-areas having saturation degree to be adjusted.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

In accordance with an embodiment of the present invention, the screen may be divided into a plurality of sub-regions according to a region range in which backlight is independently and dynamically adjustable on the screen. Whether the saturation degree of the sub-regions needs to be enhanced may be determined on the basis of the saturation degree of a picture. If the saturation degree of the sub-regions needs to be enhanced, the backlight brightness will be reduced to improve the saturation degree of the RGBW image signal. As an example, in an embodiment of the present invention the brightness values of the RGB sub-pixels in the areas may be improved to reduce total brightness loss, for example, to keep a constant brightness of the picture in the areas.

In an exemplary embodiment of the present invention, a method for improving saturation degree of RGBW image is provided. FIG. 1 is a flow chart of a method for improving saturation degree of the RGBW image according to an embodiment of the present invention. With reference to FIG. 1, the method for improving saturation degree of the RGBW image according to the embodiment may include:

a preprocessing step P of, if the image to be displayed is a RGB image, converting the RGB image into the RGBW image. However, this step is not necessary. This step may be omitted if the image to be displayed is a RGBW image.

It should be noted that several methods for converting the RGB image into the RGBW image have been proposed in the prior art. For example, the conversion of the RGB image into the RGBW image may be performed according to the following equations:

$$R_{out}=R_{in}-\mathrm{Min}(R_{in},G_{in},B_{in}) \tag{1-1}$$

$$G_{out}=G_{in}-\mathrm{Min}(R_{in},G_{in},B_{in}) \tag{1-2}$$

$$B_{out}=B_{in}-\mathrm{Min}(R_{in},G_{in},B_{in}) \tag{1-3}$$

$$W_{out}=\mathrm{Min}(R_{in},G_{in},B_{in}) \tag{1-4}$$

where $R_{in}$, $G_{in}$ and $B_{in}$ are pixel values of the sub-pixels in the RGB image signal respectively, $R_{out}$, $G_{out}$, $B_{out}$ and $W_{out}$ are pixel values of the sub-pixels in the converted RGBW image signal respectively, $W_{out}=\mathrm{Min}(R_{in}, G_{in}\ B_{in})$, i.e., $W_{out}$ is minimum of $R_{in}$, $G_{in}$ and $B_{in}$.

In addition, the conversion of the RGB image into the RGBW image may alternatively be performed according to the following equations:

$$R_{out}=Y_{in}-1.37V_{in} \tag{2-1}$$

$$G_{out}=Y_{in}-0.698V_{in}-0.336U_{in} \tag{2-2}$$

$$B_{out}=Y_{in}+1.732U_{in} \tag{2-3}$$

$$W_{out}=Y_{in} \tag{2-4}$$

where $Y_{in}$, $U_{in}$ and $V_{in}$ are values derived by converting the RGB signal into YUV image signal. $R_{out}$, $G_{out}$, $B_{out}$ and $W_{out}$ are pixel values of the sub-pixels of the RGBW image signal respectively.

It should be noted that the above methods are only exemplary. In the embodiment of the present invention, the method for converting the RGB image into the RGBW image includes, but not limited to the above methods.

In an embodiment of the present invention, the method for improving saturation degree of a RGBW image may comprises:

a step A of dividing a screen into a plurality of screen sub-regions according to a region range in which backlight is independently and dynamically adjustable on the screen. As an example, the division of the screen may be performed on the region in which backlight brightness is independently and dynamically adjustable.

Figure 2:
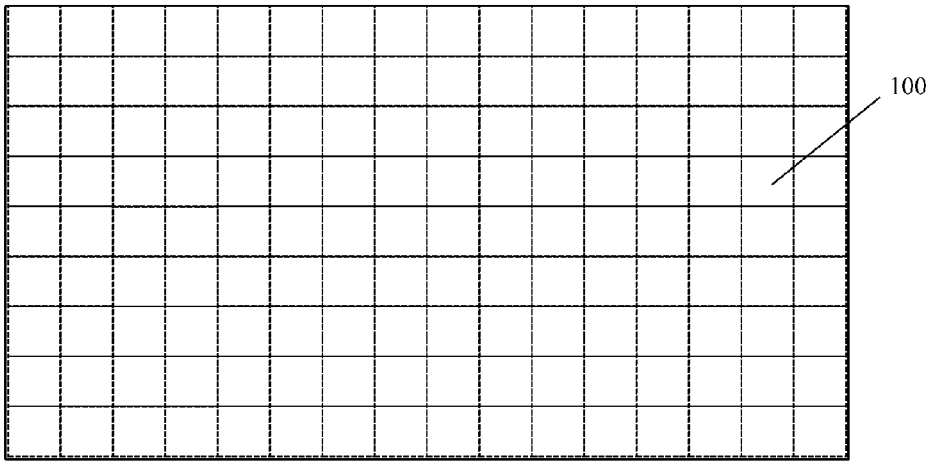
FIG. 2 is a schematic view showing sub-regions division in the method for improving saturation degree of the RGBW image as shown in FIG. 1.

In an embodiment shown in FIG. 2, the region range in which backlight is independently and dynamically adjustable on the screen has a rectangular shape. Correspondingly, the sub-regions are also rectangular. The range and number of the sub-regions depend on the number and distribution of LED lamps in backlight. As an example, the backlight brightness of each of the sub-regions may be adjusted independently and dynamically.

FIG. 2 is a schematic view showing sub-regions division in the method for improving saturation degree of the RGBW image as shown in FIG. 1. For the sub-regions 100 as shown in FIG. 2, a unit for forming their backlight may be 16×9 direct type LED array, or side emission type LED backlight unit with horizontal 16 LEDs and vertical 9 LEDs, or other structures that can form 16×9 backlight independently adjustable sub-regions 100.

The method for improving saturation degree of a RGBW image according to an embodiment may further comprise: a step B of dividing the RGBW image to be displayed into sub-areas on the basis of the screen sub-areas, the sub-areas of the RGBW image to be displayed corresponding to the sub-regions of the screen.

Figure 4:
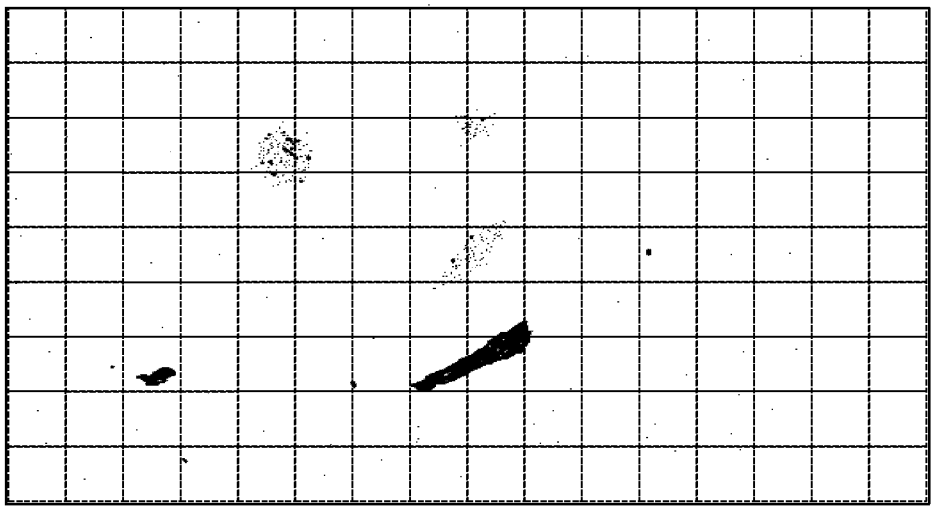
FIG. 4 is a schematic view showing distribution of high saturation degree pixels in the RGBW image to be displayed.

FIG. 4 is a schematic view showing distribution of high saturation degree pixels in the RGBW image to be displayed. With reference to FIG. 4, black spots represent high saturation pixels. From FIG. 4, it can be seen that high saturation degree pixels are distributed in a plurality of sub-areas.

It should be noted that communication areas 200 composed of high saturation degree pixels may cover two or more sub-areas. In the subsequent steps, a certain process may be performed for the case that it covers two or more sub-areas.

The method for improving saturation degree of a RGBW image according to an embodiment may further comprise: a step C of determining the sub-areas having saturation degree to be adjusted in the sub-areas of the RGBW image to be displayed.

Figure 3A:
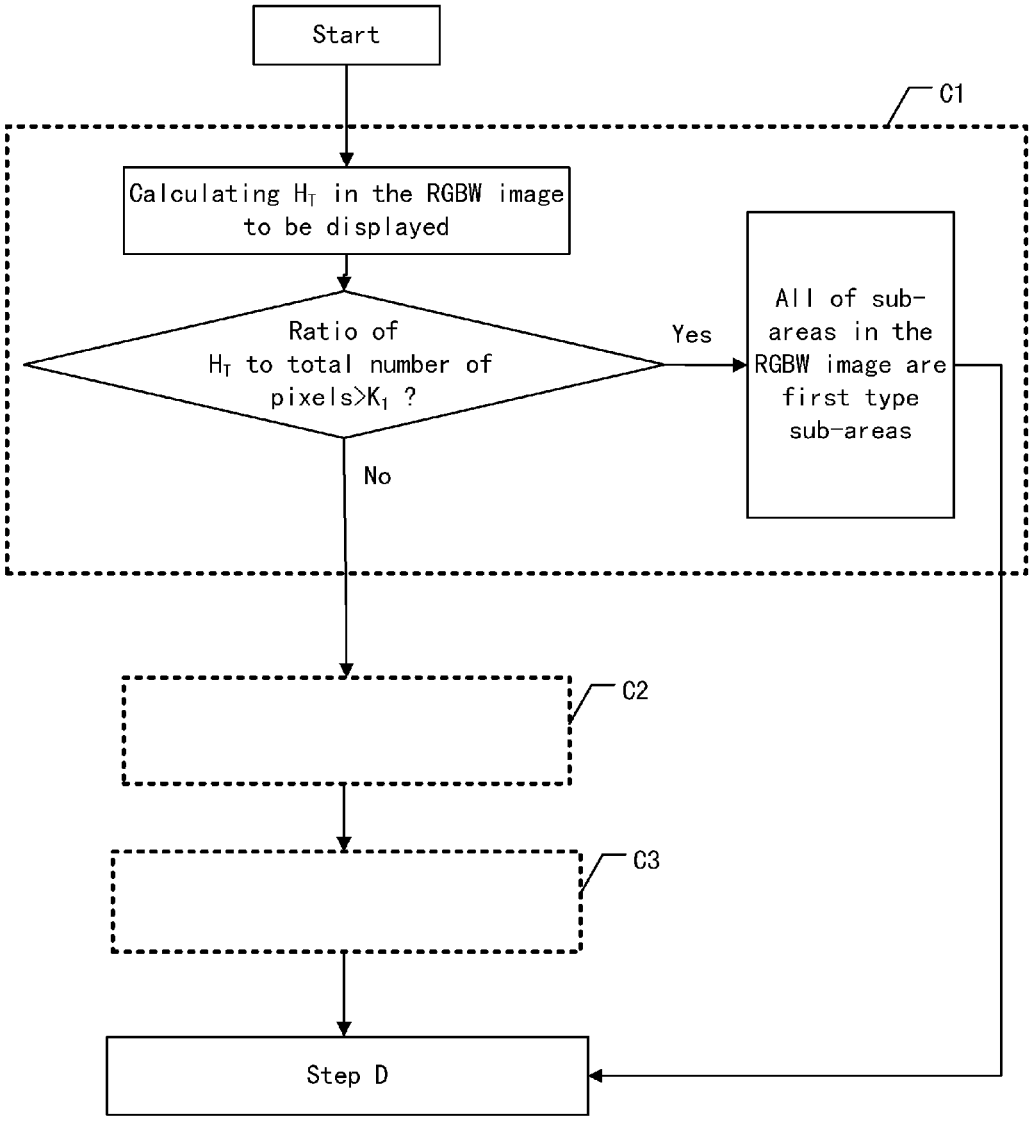
FIG. 3*a* is a flow chart of classifying the sub-areas in the method for improving saturation degree of the RGBW image as shown in FIG. 1.
Figure 3B:
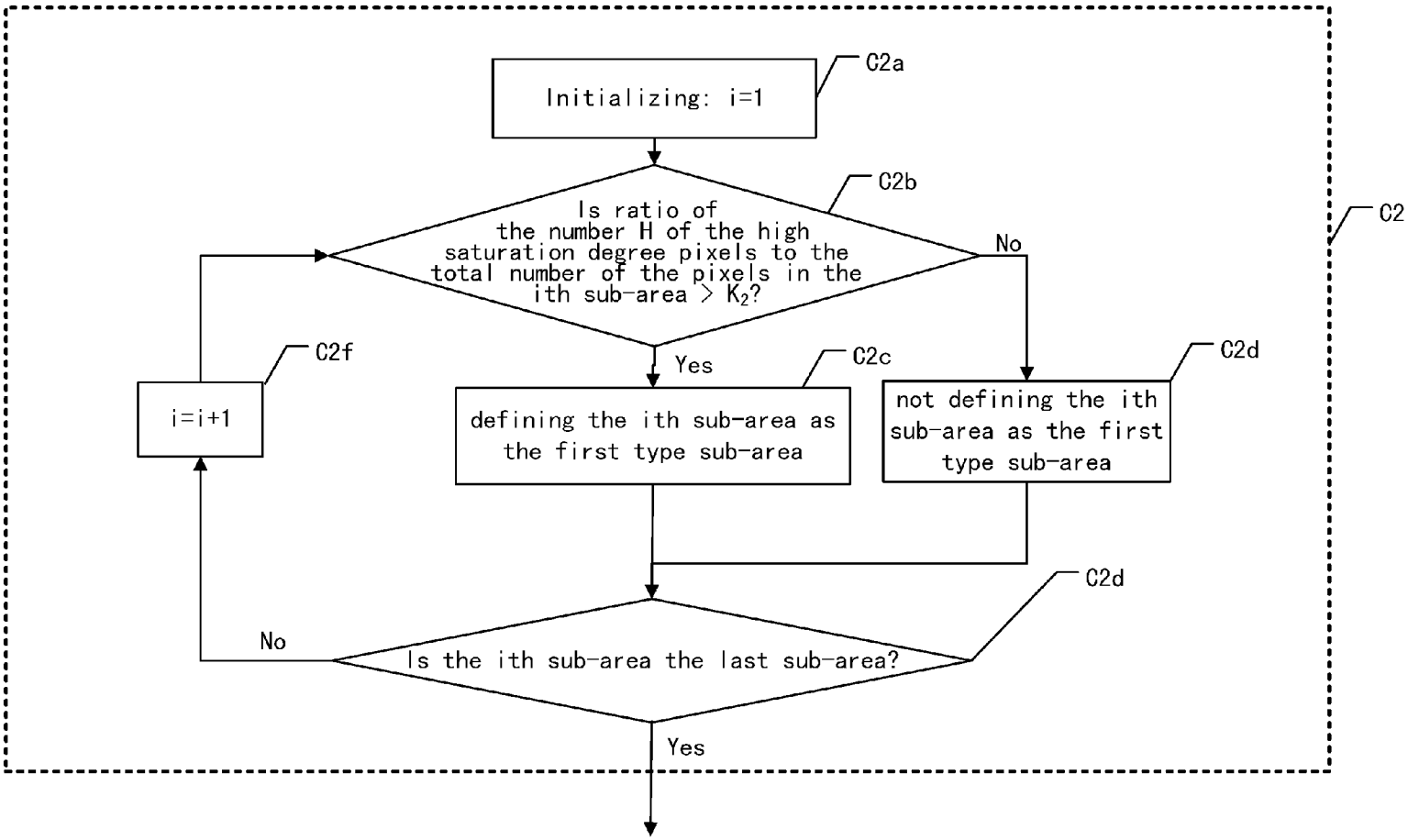
FIG. 3*b* is a flow chart of the sub-step C2 in the method as shown in FIG. 3*a;*
Figure 3C:
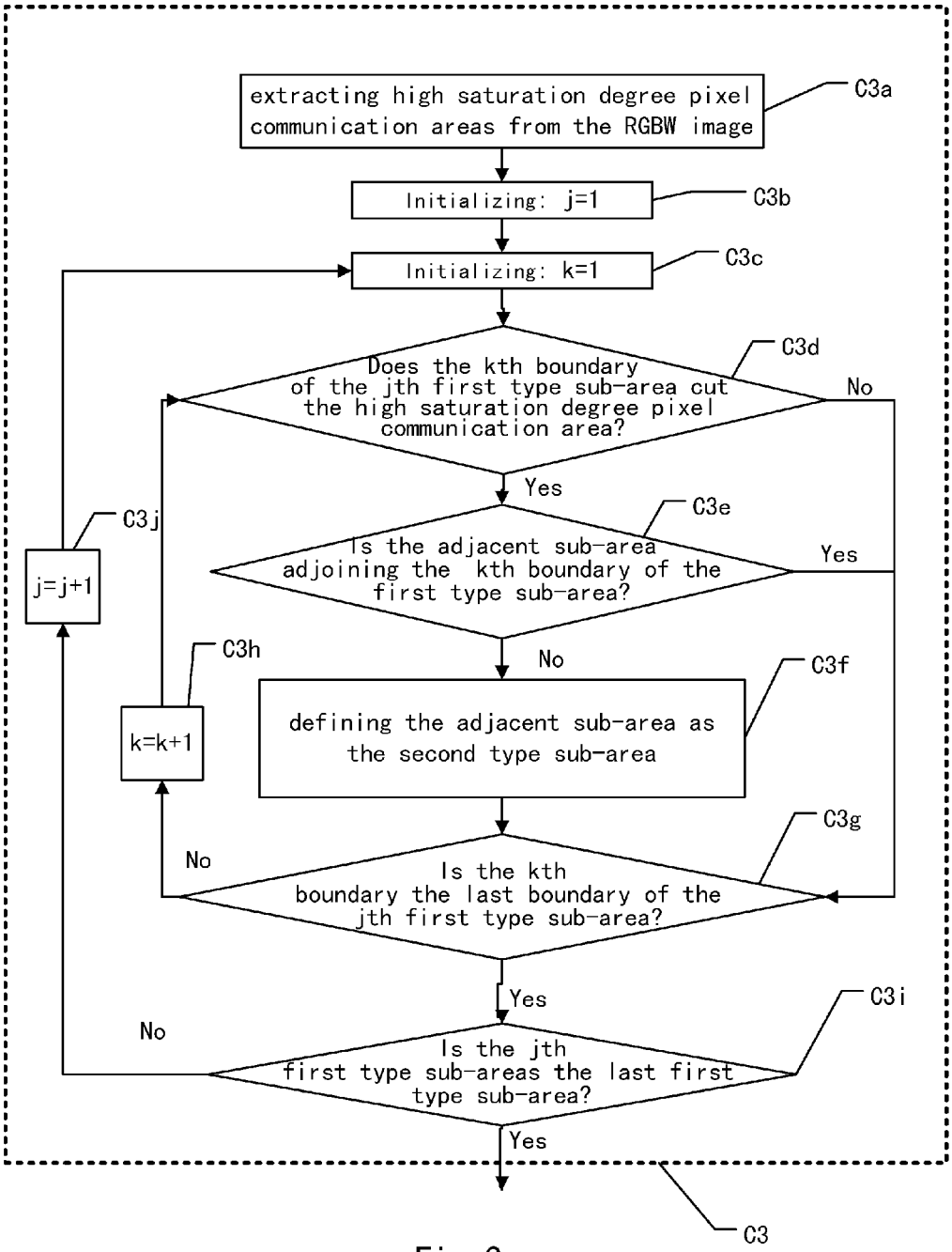
FIG. 3*c* is a flow chart of the sub-step C3 in the method as shown in FIG. 3*a;*

In the step C, classification of the sub-areas are performed with reference to the picture saturation. FIG. 3*a*-3*c* show a flow chart of classifying the sub-areas in the method for improving saturation degree of the RGBW image as shown in FIG. 1. With reference to FIG. 3*a*, the step for classifying the sub-areas may include:

sub-step C1 of calculating the number $H_T$ of the high saturation degree pixels in the RGBW image to be displayed; and if the ratio of the number $H_T$ to the total number of the pixels in the RGBW image to be displayed is greater than a predetermined first proportional factor $K_1$, all of sub-areas of the RGBW image to be displayed will be determined as the first type sub-areas having saturation degree to be adjusted and the step C will end (go to the step D directly); otherwise, the step C continues to carry out the sub-step C2.

The high saturation degree pixels are defined as pixels having saturation degree value greater than a certain threshold $S_T$. The numerical range of $S_T$ is 0.8~1.0. As an example, $S_T$=0.9. The first proportional factor $K_1$ has a value between 0.5 and 1, for example, $K_1$=0.8.

In the step C, the saturation degree value of pixels in the RGBW image to be displayed may be calculated on the basis of the following equation:

$$S = \frac{\mathrm{Max}(R_{in}, G_{in}, B_{in}) - \mathrm{Min}(R_{in}, G_{in}, B_{in})}{\mathrm{Max}(R_{in}, G_{in}, B_{in})} = 1 - \frac{\mathrm{Min}(R_{in}, G_{in}, B_{in})}{\mathrm{Max}(R_{in}, G_{in}, B_{in})} \quad (3)$$

where $R_{in}$, $G_{in}$ and $B_{in}$ are brightness values of red, green and blue sub-pixels in the corresponding pixels respectively. Max( ) and Min( ) are the function for solving maximum and the function for solving minimum respectively. In the embodiment of the present invention, improvement of Max ($R_{in}$, $G_{in}$, $B_{in}$) is intended to enhance the saturation degree S.

In the sub-step C1, if $H_T > K_1 \times$total number of pixels, i.e., the ratio of the high saturation degree pixels to the total pixels in an entire picture exceeds a certain value, all of sub-areas will be determined as the first type sub-areas having saturation degree to be adjusted, that is, the operation of improving the saturation degree will be performed on all of pixels.

For the sake of convenience, as an example, the sub-areas having saturation degree to be adjusted may include first type sub-areas having saturation degree to be adjusted and second type sub-areas having saturation degree to be adjusted. For example, the first type sub-areas having saturation degree to be adjusted are those in which the high saturation degree pixels occupy a very high proportion. The second type sub-area having saturation degree to be adjusted is different from the first type sub-areas having saturation degree to be adjusted, but it is adjacent to the first type sub-areas having saturation degree to be adjusted and contains the same one high saturation degree pixel communication area 200 as the adjacent first type sub-areas having saturation degree to be adjusted contains, that is, one high saturation degree pixel communication area 200 falls within both of the second type sub-area and its adjacent first type sub-area(s).

The step C may further include a sub-step C2 of calculating the number H of high saturation degree pixels in at least one (e.g., each) sub-area of the RGBW image to be displayed and determining whether the ratio of the number H to the total number of the pixels in the sub-area is greater than a predetermined second proportional factor $K_2$, and if the ratio of the number H to the total number of pixels in the sub-area is greater than a predetermined second proportional factor $K_2$, the sub-area is determined as the first type sub-area having saturation degree to be adjusted.

The second proportional factor $K_2$ has a value between 0 and 1, as required. Typically, the value of the second proportional factor $K_2$ is between 0.5 and 1, for example, $K_2$=0.8.

It should be noted that the above sub-step C1 is not necessary, and for example, the sub-areas having saturation degree to be adjusted may be determined directly by the sub-step C2. However, in case that the number of the high saturation degree pixels is large, the sub-step C1 may improve the calculation efficiency significantly.

In an example, as shown in FIG. 3*b*, the sub-step C2 may further include:

a sub-step C2*a* of initializing, i=1;

a sub-step C2*b* of determining whether the ratio of the number H of the high saturation degree pixels to the total number of the pixels in the ith sub-area is greater than the predetermined proportional factor $K_2$, and if yes, turning to the sub-step C2*c*, otherwise, turning to the sub-step C2*d;* a sub-step C2*c* of defining the ith sub-area as the first type sub-area having saturation degree to be adjusted and turning to the sub-step C2*e;* a sub-step C2*d* of turning to the sub-step C2*e* without defining the ith sub-area as the sub-area having saturation degree to be adjusted;

a sub-step C2*e* of determining whether the ith sub-area is the last sub-area, and if yes, turning to the sub-step C3, otherwise, turning to the sub-step C2*f;* a sub-step C2*f* of i=i+1, turning to the sub-step C2*b*.

However, the embodiments of the present invention are not limited to the above example, for example, may use different initialization values, or the above accumulating algorithm may be replaced by a progressively decreasing algorithm or even an algorithm for calculating the sub-areas in any orders. All of algorithms that can determine at least one first type sub-areas having saturation degree to be adjusted by searching at least one sub-areas fall within the sub-step C2 of the embodiment of the present invention. As an example, the sub-step C2 may search all of sub-areas to determine all of the first type sub-areas having saturation degree to be adjusted.

As an example, the step C may further include sub-step C3 of detecting the boundary of the at least one (such as each) first type sub-areas having saturation degree to be adjusted in the RGBW image to be displayed to determine whether the boundary cuts a communication area of the high saturation degree pixels; and if the boundary cuts a communication area of the high saturation degree pixels, it will determine whether the adjacent sub-area adjoining the boundary is the first type sub-areas having saturation degree to be adjusted; and if the adjacent sub-area adjoining the boundary is not the first type sub-areas having saturation degree to be adjusted, the adjacent sub-area will be determined as the second type sub-areas having saturation degree to be adjusted; otherwise, no actions are performed.

In the above example of the present invention, it is assumed that the high saturation degree pixels in one communication area has a close correlation and should be subject to consistent improvement of saturation degree instead of independent improvement of saturation degree respectively.

In practice, as an example, with reference to FIG. 3*c*, the sub-step C3 may further include:

extracting one or more high saturation degree pixel communication areas 200 from the RGBW image to be displayed by using an image splitting means; and individually detecting each of boundaries of each of the first type sub-areas having saturation degree to be adjusted to determine whether the boundary cuts the high saturation degree pixel communication area 200, and if the boundary cuts the high saturation degree pixel communication area 200, it will determine whether the adjacent sub-area adjoining the boundary is the first type sub-area having saturation degree to be adjusted, and if the adjacent sub-area adjoining the boundary is not the first type sub-area having saturation degree to be adjusted, the adjacent sub-area adjoining the boundary will be determined as the second type sub-area having saturation degree to be adjusted, until all of the first type sub-area having saturation degree to be adjusted have been detected.

As an example, as illustrated in FIG. 3*c*, the sub-step C3 may further include sub-step C3*a* of extracting one or more high saturation degree pixel communication areas 200 from the RGBW image to be displayed by using an image splitting technology.

Figure 5:
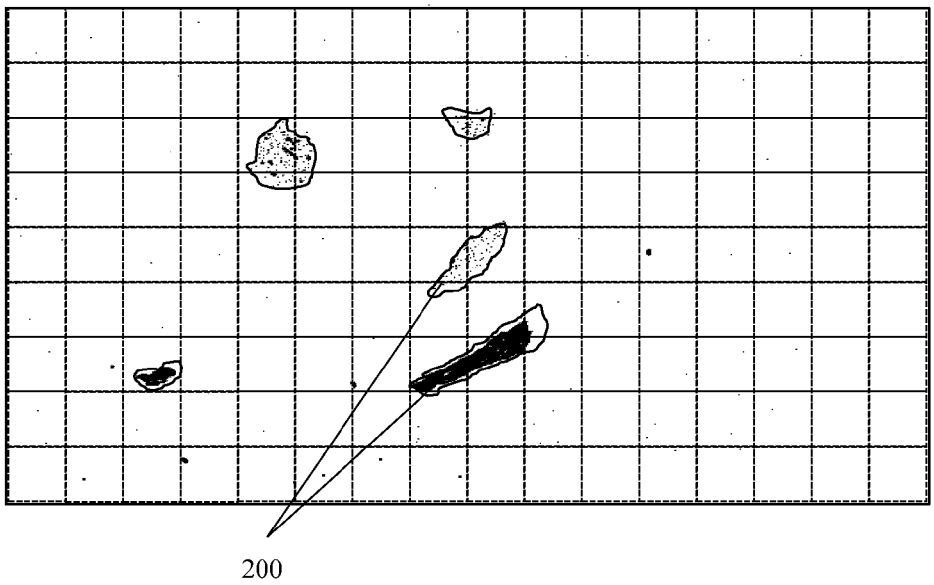
FIG. 5 is a schematic view showing extraction of one or more high saturation degree pixels communication areas from the RGBW image to be displayed by using image splitting means.

With reference to FIG. 5, it is a schematic view showing extraction one or more high saturation degree pixels communication areas from the RGBW image to be displayed by using image splitting means. In FIG. 5, the high saturation degree pixel communication areas 200 are represented in curve line frames respectively.

As an example, the sub-step C3 may include:

a sub-step C3*b* of initializing, j=1;

a sub-step C3*c* of initializing, k=1;

a sub-step C3*d* of detecting the kth boundary of the jth first type sub-areas having saturation degree to be adjusted and determining whether it cuts the high saturation degree pixel communication area, and if yes, turning to the sub-step C3*e*, otherwise, turning to the sub-step C3*g;* a sub-step C3*e* of determining whether the adjacent sub-area adjoining the kth boundary is the first type sub-area having saturation degree to be adjusted, and if yes, turning to the sub-step C3*g*, otherwise, turning to the sub-step C3*f;* a sub-step C3*f* of defining the adjacent sub-area as the second type sub-area having saturation degree to be adjusted and turning to the sub-step C3*g;* a sub-step C3*g* of determining whether the kth boundary is the last boundary of the jth first type sub-area having saturation degree to be adjusted, and if yes, turning to the sub-step C3*i*, otherwise, turning to the sub-step C3*h;* a sub-step C3*h* of k=k+1, turning to the sub-step C3*d;* a sub-step C3*i* of determining whether the jth first type sub-areas having saturation degree to be adjusted is the last first type sub-area having saturation degree to be adjusted, and if yes, turning to the sub-step D, otherwise, turning to the sub-step C3*j*; and a sub-step C3*j* of j=j+1, returning to the sub-step C3*c*.

However, the embodiments of the present invention are not limited to the above example, and for example, may use different initialization values, or the above accumulating algorithm may be replaced by a progressively decreasing algorithm or even an algorithm for calculating the sub-areas in any orders. All of algorithms that can determine at least one first/second type sub-areas having saturation degree to be adjusted by searching at least one sub-areas fall within the sub-step C3 of the embodiment of the present invention. As an example, the sub-step C3 may search all of sub-areas to determine all of the first/second type sub-areas having saturation degree to be adjusted.

The method for improving saturation degree of the RGBW image according to the present invention may further include a step D of reducing the backlight brightness in the sub-areas having saturation degree to be adjusted by a predetermined proportion when the RGBW image to be displayed is displayed.

In the step D, for example, the backlight brightness in the first type sub-areas having saturation degree to be adjusted and the second type sub-areas having saturation degree to be adjusted may be reduced. The backlight brightness is reduced by a proportion of 1%-30%, such as 10%, compared with the original backlight brightness, i.e., the backlight brightness of the sub-area which has not been reduced.

Figure 6:
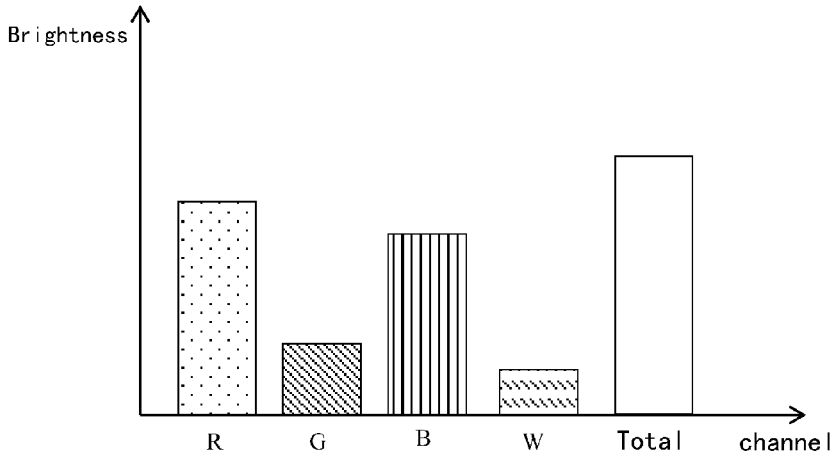
FIG. 6 is a histogram showing brightness of a RGBW image signal for each channel of the original picture in the RGBW image to be displayed.
Figure 7:
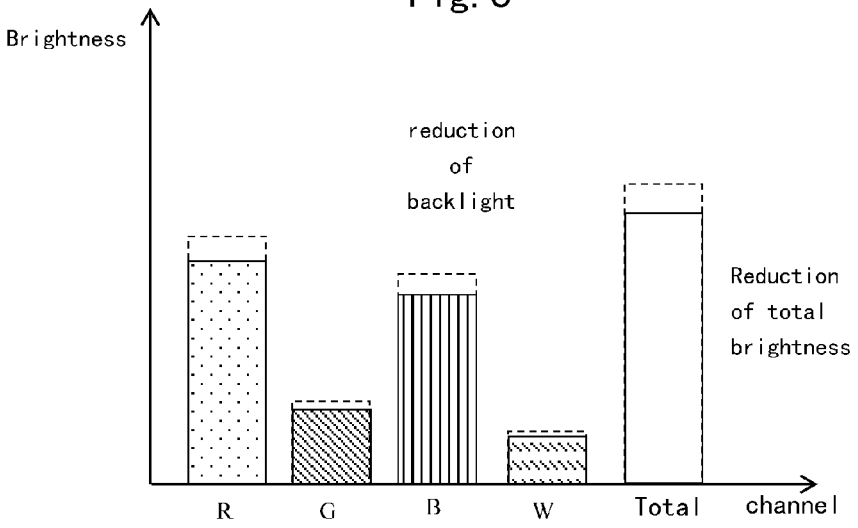
FIG. 7 is a histogram showing brightness of a RGBW image signal for each channel of the picture in the RGBW image to be displayed after the backlight is reduced.

FIG. 6 is a histogram showing brightness of a RGBW image signal for each channel of the original picture in the RGBW image to be displayed. FIG. 7 is a histogram showing brightness of a RGBW image signal for each channel of the picture in the RGBW image to be displayed after the backlight is reduced. After the step D is performed, the original picture as shown in FIG. 6 becomes the picture shown in FIG. 7.

As an example, after the step D, the method for improving saturation degree of the RGBW image according to the present invention may further include step E of improving the brightness values of the RGB pixels in the first type and second type sub-areas having saturation degree to be adjusted in which the backlight brightness has been reduced. In this way, the loss of total brightness in the sub-areas caused by reduction of backlight brightness may be reduced. As an example, the brightness value of the RGB pixels in the sub-area may be improved such that the total brightness of the sub-areas having saturation degree to be adjusted after the backlight brightness has been reduced is same to the total brightness before the backlight brightness is reduced. As an example, the brightness of R pixels, G pixels and B pixels are improved by the same proportion. Alternatively, as an example, the brightness of R pixels, G pixels and B pixels may be improved by different proportions.

For example, the brightness values of the RGB pixels are raised by a proportion of 1%~30%, such as 10%, compared with the original brightness values of the RGB pixels, i.e., the brightness values of the RGB pixels of the sub-area which has not been reduced.

Figure 8:
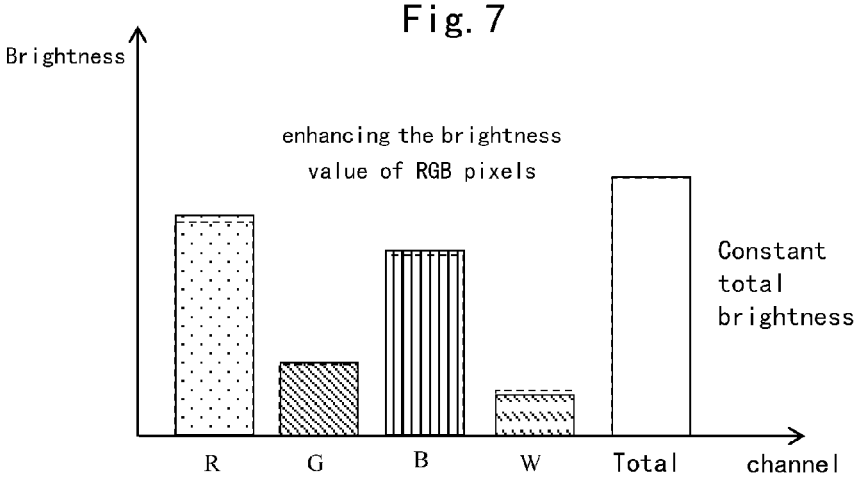
FIG. 8 is a histogram showing brightness of a RGBW image signal for each channel of the picture in the RGBW image to be displayed after the brightness values of the RGB pixels are enhanced.

FIG. 8 is a histogram showing brightness of a RGBW image signal for each channel of the picture in the RGBW image to be displayed after the brightness values of the RGB pixels are enhanced. After the step E is performed, the picture as shown in FIG. 8 is obtained finally.

Figure 9:
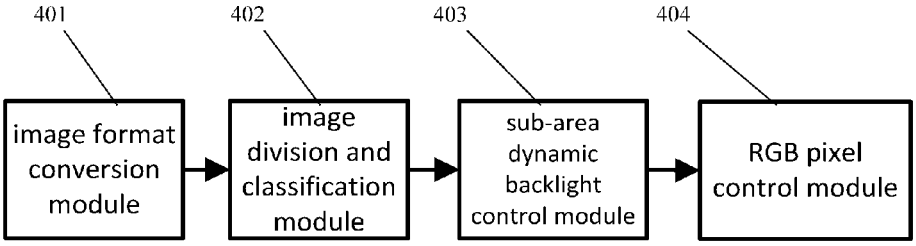
FIG. 9 is a schematic view showing a structure of the system for improving saturation degree of the RGBW image according to an embodiment of the present invention.

With reference to the above method for improving saturation degree of the RGBW image, in an exemplary embodiment of the present invention, a system for improving saturation degree of the RGBW image is provided. FIG. 9 is a schematic view showing a structure of the system for improving saturation degree of the RGBW image according to an embodiment of the present invention. With reference to FIG. 9, the system for improving a RGBW image saturation degree comprises:

an image format conversion module 401 configured to convert a RGB image into the RGBW image;

an image division and classification module 402 configured to divide the RGBW image to be displayed into sub-areas according to a region range in which backlight is independently and dynamically adjustable on the screen and to determine sub-areas having saturation degree to be adjusted, for example the first/second type sub-areas having saturation degree to be adjusted;

a sub-area dynamic backlight control module 403 configured to reduce the backlight brightness of the sub-areas having saturation degree to be adjusted, for example, including the first/second type sub-areas having saturation degree to be adjusted; and a RGB pixel control module 404 configured to improve the brightness values of RGB pixels in the sub-areas having saturation degree to be adjusted in which the backlight brightness has been reduced.

In the above system for improving saturation degree of the RGBW image, the image format conversion module 401 and the RGB pixel control module 404 are optional. For example, if the inputted image is the RGBW image, the image format conversion module 401 may be omitted. The RGB pixel control module 404 is used to reduce the loss of total brightness of the sub-areas caused by reduction of backlight brightness. As an example, the RGB pixel control module 404 may improve the brightness values of the RGB pixels by the same proportion as the proportion by which the backlight brightness is reduced so as to improve the saturation degree without changing the total brightness of the sub-areas.

Figure 10:
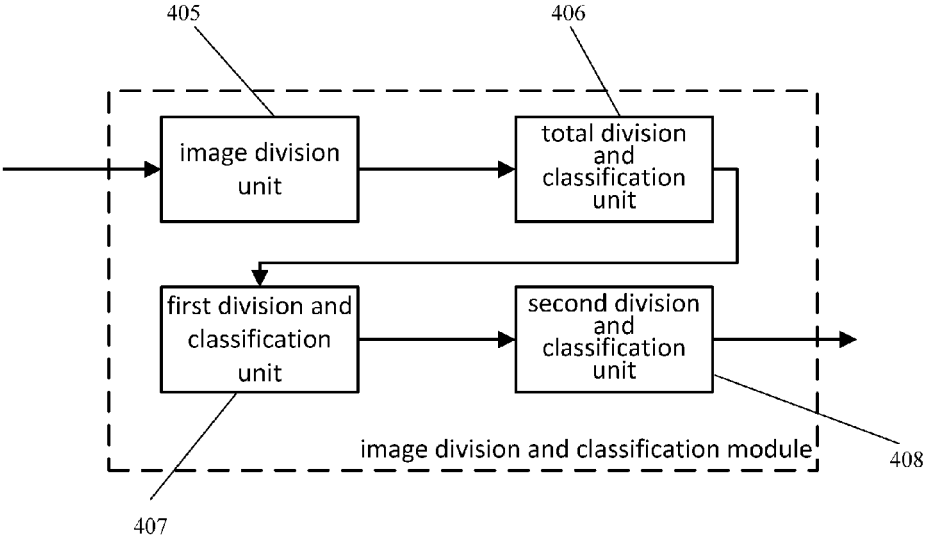
FIG. 10 is a schematic view showing a structure of an image division and classification module in the system for improving saturation degree of the RGBW image shown in FIG. 9.

FIG. 10 is a schematic view showing a structure of an image division and classification module in the system for improving saturation degree of the RGBW image shown in FIG. 9. With reference to FIG. 10, the RGB pixel control module 402 comprises:

an image division unit 405 configured to divide the RGBW image to be displayed on the basis of screen sub-regions, the screen sub-regions being divided according to a region range in which backlight is independently and dynamically adjustable on the screen, the sub-areas of the RGBW image to be displayed corresponding to the sub-regions of the screen;

a total division and classification unit 406 configured to calculate the number $H_T$ of the high saturation degree pixels in the RGBW image to be displayed; and if the ratio of the number $H_T$ to the total number of the pixels in the RGBW image to be displayed is greater than a predetermined first proportional factor $K_1$, all of sub-areas of the RGBW image to be displayed are determined as the first type sub-area having saturation degree to be adjusted;

a first division and classification unit 407 configured to determine whether the ratio of the number H of high saturation degree pixels in each sub-area of the RGBW image to be displayed to the total number of pixels in the sub-area is greater than a predetermined second proportional factor $K_2$, and if the ratio is greater than a predetermined second proportional factor $K_2$, the sub-area are determined as the first type sub-area having saturation degree to be adjusted; and a second division and classification unit 408 configured to detect a boundary of the at least one first type sub-areas having saturation degree to be adjusted in the RGBW image to be displayed to determine whether the boundary cuts a high saturation degree pixel communication area; and if the boundary cuts the high saturation degree pixel communication area, whether the adjacent sub-area adjoining the boundary is the first type sub-areas having saturation degree to be adjusted is determined; and if the adjacent sub-area adjoining the boundary is not the first type sub-areas having saturation degree to be adjusted, the adjacent sub-area will be determined as the second type sub-areas having saturation degree to be adjusted, otherwise, if the adjacent sub-area adjoining the boundary is the first type sub-areas having saturation degree to be adjusted, no actions are performed.

In the above system, the total division and classification unit 406 and the second division and classification unit 408 are both optional. However, in the case that the number of the high saturation degree pixels is large, provision of the total division and classification unit 406 may improve the calculation efficiency. The second division and classification unit 408 is used to consistently adjust saturation degree of the high saturation degree pixel communication area 200 in entirety.

It should be noted that the method for improving saturation degree of the RGBW image according to the embodiment of the present invention may be performed by the system for improving saturation degree of the RGBW image according to the embodiment of the present invention. All of the above technical solutions in the method according to the embodiment of the present invention may be applied to embodiments of the system. However, the system for improving saturation degree of the RGBW image according to the embodiment of the present invention is not limited to performing the above method.

In addition, the above definitions to the respective elements and methods are not limited to various specific structures, shapes or means described in the embodiments, and the skilled person in the art may replace or modify them easily, for example, (1) the means of converting the RGB image into the RGBW image are not limited to the two means described above;

(2) the skilled person in the art may provide values of the threshold $S_T$ and the predetermined proportional factor $K_1$ as required.

As an example, the method and system for improving saturation degree of the RGBW image according to an embodiment of the present invention may, in combination with CABC (Content Adaptive Backlight Control) technique, divide the screen into a plurality of sub-regions according to a region range in which backlight is independently and dynamically adjustable and determine whether saturation degree of the sub-areas needs to be improved on the basis of saturation degree of the picture.

If saturation degree of the respective sub-areas in the RGBW image to be displayed needs to be improved, the backlight brightness of them will be reduced to finely adjust the saturation degree of the respective sub-areas in the RGBW image. Further, reduction of backlight brightness may reduce power consumption of the entire module to meet the requirement of energy conservation. As an example, while reducing backlight brightness of sub-areas having saturation degree to be adjusted, the system and the method according to an embodiment of the present invention may improve the brightness values of the RGB sub-pixels in the sub-areas to keep entire brightness of the sub-areas constant.

It should be noted that the algorithm and display in the above embodiments are not inherently correlated to any specific computers, virtual systems or other apparatuses. All of generic system may also be used according to the teaching. In accordance with the above description, it is apparent to form the structures required by such system. In addition, the present invention is not limited by any specific program languages. It should be appreciated that various program languages may be used to achieve the contents of the present invention and the above description to the specific language is only exemplary instead of limiting the present invention.

Further, in the embodiments of the present invention, all of components may be implemented as hardware or software module running on one or more processors, or the combination thereof. As appreciated, in practice, some functions of the relevant apparatus or parts or all of functions of components in the apparatus according to the embodiments of the present invention may be implemented by microprocessors or digital signal processor (DSP). The embodiments of the present invention may also be implemented as an apparatus or a device program for executing parts or all of methods described herein, for example, a computer program or a computer program product. Such program for achieving an embodiment of the present invention may be recorded on a computer readable medium, or may have forms of one or more signals. Such signal may be downloaded from sites of Internet, or provided on carrier signals or provided in any other forms.

Although several exemplary embodiments have been shown and described, the present invention is not limited to those and it would be appreciated by those skilled in the art that various changes or modifications may be made in these embodiments without departing from the principles and spirit of the disclosure, the scope of which is defined in the claims and their equivalents.

What is claimed is:

1. A method for improving saturation degree of a RGBW image, comprising:

a step A of dividing a screen into a plurality of screen sub-regions according to a region range in which backlight is independently and dynamically adjustable on the screen;

a step B of dividing the RGBW image to be displayed into sub-areas on the basis of the screen sub-regions, the sub-areas of the RGBW image to be displayed corresponding to the screen sub-regions;

a step C of determining the sub-areas having saturation degree to be adjusted in all of sub-areas of the RGBW image to be displayed; and a step D of reducing backlight brightness of the sub-areas having saturation degree to be adjusted by a predetermined proportion when the RGBW image to be displayed is displayed;

wherein the sub-areas having saturation degree to be adjusted comprise first type sub-areas having saturation degree to be adjusted and second type sub-areas having saturation degree to be adjusted, the step C comprising:

a sub-step C2 of calculating a number H of high saturation degree pixels in at least one sub-area of the RGBW image to be displayed, and if a ratio of the number H to a total number of pixels in the sub-area is greater than a predetermined second proportional factor $K_2$, the sub-area is determined as the first type sub-area having saturation degree to be adjusted, and a sub-step C3 of detecting a boundary of the at least one first type sub-areas having saturation degree to be adjusted in the RGBW image to be displayed to determine whether the boundary intersects a communication area of the high saturation degree pixels; and if the boundary intersects the communication area of the high saturation degree pixels, whether an adjacent sub-area adjoining the boundary is one of the first type sub-areas having saturation degree to be adjusted is determined; and if the adjacent sub-area adjoining the boundary is not one of the first type sub-areas having saturation degree to be adjusted, the adjacent sub-area is determined as one of the second type sub-areas having saturation degree to be adjusted.

2. The method according to claim 1, wherein the high saturation degree pixels are pixels having the saturation degree above a threshold ST, wherein $0.8 \leq ST \leq 1.0$.

3. The method according to claim 1, wherein before the sub-step C2, the step C further comprises:

a sub-step C1 of calculating the number HT of the high saturation degree pixels in the RGBW image to be displayed; and if the ratio of the number HT to the total number of the pixels in the RGBW image to be displayed is greater than a predetermined first proportional factor K1, all of sub-areas of the RGBW image to be displayed will be determined as the first type sub-areas having saturation degree to be adjusted and the step C will end; otherwise, the step C continues to carry out the sub-step C2.

4. The method according to claim 3, wherein the first proportional factor K1 and the second proportional factor K2 meet the condition of $0.5 \leq K1 \leq 1$, and $0.5 \leq K2 \leq 1$, respectively.

5. The method according to claim 1, wherein the sub-step C3 comprises:

extracting one or more high saturation degree pixel communication areas from the RGBW image to be displayed by using an image splitting means; and individually detecting each of boundaries of each of the first type sub-areas having saturation degree to be adjusted to determine whether the boundary cuts a high saturation degree pixel communication area, and if the boundary cuts the high saturation degree pixel communication area, whether the adjacent sub-area adjoining the boundary is the first type sub-area having saturation degree to be adjusted is determined, and if the adjacent sub-area adjoining the boundary is not the first type sub-area having saturation degree to be adjusted, the adjacent sub-area adjoining the boundary is determined as the second type sub-area having saturation degree to be adjusted, until all of the first type sub-area having saturation degree to be adjusted are detected.

6. The method according to claim 1, wherein the region range in which backlight is independently and dynamically adjustable on the screen has a rectangular shape.

7. The method according to claim 1, wherein, in the step D, the backlight brightness corresponding to the sub-areas having saturation degree to be adjusted is reduced by a proportion of 1%~30% compared with the original backlight brightness.

8. The method according to claim 7, wherein, in the step D, the backlight brightness is reduced by a proportion of 10% compared with the original backlight brightness.

9. The method according to claim 1, further comprising, before the step A, if the image to be displayed is a RGB image, the RGB image will be converted into the RGBW image.

10. The method according to claim 1, wherein, after the step D, the method further comprises:

a step E of improving brightness values of RGB pixels in the sub-areas having saturation degree to be adjusted after the backlight brightness has been reduced.

11. The method according to claim 10, wherein total brightness in the sub-areas having saturation degree to be adjusted in which the backlight brightness has been reduced is same to that in the sub-areas having saturation degree to be adjusted before its backlight brightness is reduced, and wherein the brightness of R pixels, G pixels and B pixels are improved by the same proportion.

12. A system for improving saturation degree of a RGBW image, comprising:

an image division and classification module configured to divide the RGBW image to be displayed into sub-areas according to a region range in which backlight is independently and dynamically adjustable on the screen and to determine sub-areas having saturation degree to be adjusted; and a sub-area dynamic backlight control module configured to reduce the backlight brightness of the sub-areas having saturation degree to be adjusted;

wherein the sub-areas having saturation degree to be adjusted comprises first type sub-areas having saturation degree to be adjusted and second type sub-areas having saturation degree to be adjusted, the image division and classification module comprising:

an image division unit configured to divide the RGBW image to be displayed on the basis of screen sub-regions, the screen sub-regions being divided according to a region range in which backlight is independently and dynamically adjustable on the screen, the sub-areas of the RGBW image to be displayed corresponding to the sub-regions of the screen;

a first division and classification unit configured to determine whether a ratio of a number H of high saturation degree pixels in each sub-area of the RGBW image to be displayed to a total number of pixels in the sub-area is greater than a predetermined second proportional factor K2, and if the ratio is greater than a predetermined second proportional factor K2, the sub-area is determined as the first type sub-area having saturation degree to be adjusted; and a second division and classification unit configured to detect a boundary of the at least one first type sub-areas having saturation degree to be adjusted in the RGBW image to be displayed to determine whether the boundary intersects a high saturation degree pixel communication area; and if the boundary intersects the high saturation degree pixel communication area, whether an adjacent sub-area adjoining the boundary is one of the first type sub-areas having saturation degree to be adjusted is determined; and if the adjacent sub-area adjoining the boundary is not one of the first type sub-areas having saturation degree to be adjusted, the adjacent sub-area is determined as one of the second type sub-areas having saturation degree to be adjusted.

13. The system according to claim 12, wherein the image division and classification module further comprises:

a total division and classification unit configured to calculate the number HT of the high saturation degree pixels in the RGBW image to be displayed; and if the ratio of the number HT to the total number of the pixels in the RGBW image to be displayed is greater than a predetermined first proportional factor K1, all of sub-areas of the RGBW image to be displayed are determined as the first type sub-areas having saturation degree to be adjusted.

14. The system according to claim 12, further comprising:

an image format conversion module configured to convert a RGB image into the RGBW image.

15. The system according to claim 12, further comprising:

a RGB pixel control module configured to improve brightness values of RGB pixels in the sub-areas having saturation degree to be adjusted in which the backlight brightness has been reduced.

16. The system according to claim 15, wherein the RGB pixel control module is configured to increase the brightness values of the RGB pixels in the sub-areas having saturation degree to be adjusted by the same proportion as the proportion by which the backlight brightness has been reduced so as to keep total brightness of the sub-areas having saturation degree to be adjusted constant.

17. A system for improving saturation degree of a RGBW image, comprising a processor and a computer readable medium, wherein the processor is configured to execute:

a process to divide the RGBW image to be displayed into sub-areas according to a region range in which backlight is independently and dynamically adjustable on the screen and to determine sub-areas having saturation degree to be adjusted; and a process to reduce the backlight brightness of the sub-areas having saturation degree to be adjusted;

wherein the sub-areas having saturation degree to be adjusted comprise first type sub-areas having saturation degree to be adjusted and second type sub-areas having saturation degree to be adjusted, the process to divide the RGBW image to be displayed into sub-areas comprising:

a first sub-process to divide the RGBW image to be displayed on the basis of screen sub-regions, the screen sub-regions being divided according to a region range in which backlight is independently and dynamically adjustable on the screen, the sub-areas of the RGBW image to be displayed corresponding to the sub-regions of the screen;

a second sub-process to determine whether a ratio of a number H of high saturation degree pixels in each sub-area of the RGBW image to be displayed to a total number of pixels in the sub-area is greater than a predetermined second proportional factor K2, and in response to the ratio being greater than a predetermined second proportional factor K2, the sub-area is determined as the first type sub-area having saturation degree to be adjusted; and a third sub-process to detect a boundary of the at least one first type sub-areas having saturation degree to be adjusted in the RGBW image to be displayed to determine whether the boundary intersects a high saturation degree pixel communication area; and in response to the boundary intersecting the high saturation degree pixel communication area, determining whether an adjacent sub-area adjoining the boundary is one of the first type sub-areas having saturation degree to be adjusted; and in response to the adjacent sub-area adjoining the boundary not being one of the first type sub-areas having saturation degree to be adjusted, determining that the adjacent sub-area is one of the second type sub-areas having saturation degree to be adjusted.

* * * * *